US007923619B2

(12) United States Patent
Suzuki

(10) Patent No.: US 7,923,619 B2
(45) Date of Patent: Apr. 12, 2011

(54) KEYBOARD DEVICE

(75) Inventor: Hirotsugu Suzuki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 14 days.

(21) Appl. No.: 12/566,488

(22) Filed: Sep. 24, 2009

(65) Prior Publication Data

US 2010/0071533 A1 Mar. 25, 2010

(30) Foreign Application Priority Data

Sep. 25, 2008 (JP) ..... 2008-245799

(51) Int. Cl.
*G10C 3/12* (2006.01)

(52) U.S. Cl. ..... 84/423 R; 84/439

(58) Field of Classification Search ..... 84/423 R, 84/439

See application file for complete search history.

(56) References Cited

U.S. PATENT DOCUMENTS

| | | | | | |
|---|---|---|---|---|---|
| 4,860,630 | A * | 8/1989 | Franz et al. | ..... | 84/439 |
| 4,993,305 | A * | 2/1991 | Franz et al. | ..... | 84/439 |
| 5,243,125 | A * | 9/1993 | Yamaguchi | ..... | 84/745 |
| 5,574,241 | A * | 11/1996 | Kumano et al. | ..... | 84/439 |
| 5,696,340 | A * | 12/1997 | Ragni | ..... | 84/423 R |
| 5,821,443 | A * | 10/1998 | Masubushi | ..... | 84/433 |
| 5,834,668 | A * | 11/1998 | Kumano et al. | ..... | 84/423 R |
| 6,147,290 | A * | 11/2000 | Uno | ..... | 84/433 |
| 7,208,668 | B2 * | 4/2007 | Shimoda | ..... | 84/434 |
| 7,297,854 | B2 * | 11/2007 | Nishida | ..... | 84/423 R |
| 7,297,855 | B2 * | 11/2007 | Nishida | ..... | 84/423 R |
| 7,332,663 | B2 * | 2/2008 | Nishida | ..... | 84/423 R |
| 7,365,259 | B2 * | 4/2008 | Nishida | ..... | 84/423 R |
| 7,485,798 | B2 * | 2/2009 | Nishida | ..... | 84/644 |
| 7,582,821 | B2 * | 9/2009 | Watanabe | ..... | 84/423 R |
| 7,586,030 | B2 * | 9/2009 | Nishida | ..... | 84/423 R |
| 7,696,424 | B2 * | 4/2010 | Osuga et al. | ..... | 84/423 R |
| 7,709,718 | B2 * | 5/2010 | Osuga | ..... | 84/423 R |
| 7,750,222 | B2 * | 7/2010 | Osuga | ..... | 84/423 R |
| 7,767,891 | B2 * | 8/2010 | Yamaguchi | ..... | 84/423 R |
| 7,767,892 | B2 * | 8/2010 | Osuga | ..... | 84/423 R |
| 7,772,474 | B2 * | 8/2010 | Osuga | ..... | 84/423 R |
| 2010/0071531 | A1 * | 3/2010 | Kitajima | ..... | 84/423 R |
| 2010/0071532 | A1 * | 3/2010 | Kitajima et al. | ..... | 84/432 |
| 2010/0071533 | A1 * | 3/2010 | Suzuki | ..... | 84/439 |
| 2010/0071534 | A1 * | 3/2010 | Kitajima et al. | ..... | 84/439 |
| 2010/0074668 | A1 * | 3/2010 | Suzuki | ..... | 400/495 |

FOREIGN PATENT DOCUMENTS

| | | |
|---|---|---|
| JP | 06-025884 | 4/1994 |
| JP | 2004-226687 | 8/2004 |
| JP | 2007-025589 | 2/2007 |

* cited by examiner

*Primary Examiner* — Elvin G Enad
*Assistant Examiner* — Robert W Horn
(74) *Attorney, Agent, or Firm* — Morrison & Foerster LLP

(57) ABSTRACT

A plurality of keys are supported at a key support parts such that the respective keys are pivoted by a key-pressing operation of a player in a vertical direction, the keys being arranged in parallel to each other along a width direction of the keyboard device. A plurality of hammers are arranged in parallel to each other along the width direction such that the hammers correspond to the respective keys. The hammers are operatively connected to the corresponding keys to rotate about the respective hammer support parts, the hammers applying inertia to pivoting movements of the corresponding keys. A frame has an opening portion open at a front area which faces the player, and located more frontward than the hammer support parts, and the frame is constructed such that the hammer support parts are located between an upper limit position and a lower limit position of the opening portion in the vertical direction, and the hammers can be inserted into the frame through the opening portion from the front area when the hammers are mounted to the respective hammer support parts.

9 Claims, 4 Drawing Sheets

KEYBOARD DEVICE

BACKGROUND OF THE INVENTION

1. Technical Field of the Invention

The present invention relates to keyboard device wherein hammers are supported at a frame and operatively connected to keys such that the hammers rotate to apply inertia to the corresponding keys.

2. Description of the Related Art

Conventional keyboard devices have been known in which a plurality of hammers are supported at a frame and operatively connected to keys such that the hammers rotate to apply inertia to pivoting movements of the corresponding keys. In these kinds of devices, hammer support parts are provided at the frame, and the hammers are assembled to the corresponding hammer support parts in such a manner that the hammers can rotate (Patent documents 1 to 3 listed below).

In the keyboard device of Patent document 1, a mass part of each of the hammers is inserted into a slit of the frame provided for each of the hammers, such that the mass part is mounted while being ducked, when the hammers are assembled to the frame (See FIG. 8 of document 1). The hammers are inserted from above.

In the keyboard device of Patent document 2, key contact parts of the respective hammers are inserted into slit-shaped cutout parts of the frame from the front area, and the hammers are returned to the opposite side such that the hammers are engaged with hammer support parts (See FIG. 4 of document 2). The hammers are inserted from below.

In the keyboard device of Patent document 3, the hammers are inserted from front and above such that the hammers are engaged with hammer supports parts while the hammers override key guides arranged at the front side of white keys.

[Patent document 1] Japanese Utility Model Application Publication No. H6-25884

[Patent document 2] Japanese Patent Application Publication No. 2004-226687

[Patent document 3] Japanese Patent Application Publication No. 2007-25589

In the keyboard devices of Patent documents 1, 2 and 3, however, the hammers must be inserted into the frame from above or below due to restrictions caused by the shape of the frame or obstacles such as the key guides.

Particularly, in Patent document 1, it is necessary to assemble the hammers to the frame while changing the direction in which the hammers are inserted, and the range of fluctuation in the direction is also large. Also, in Patent document 2, it is necessary to change the direction in which the hammers are inserted and, in addition, to move the hammers in the reverse direction once. Also, in Patent document 3, the key guides become obstacles, with the result that it is necessary to assemble the hammers to the frame while changing the angle at which the hammers are inserted, and the range of fluctuation in the angle is also large.

For these reasons, each of the conventional keyboard devices has a problem in that it is not easy to assembly the hammers to the frame.

SUMMARY OF THE INVENTION

Therefore, the present invention has been made to solve the above problem of the related art, and it is an object of the present invention to provide a keyboard device constructed such that hammers can be inserted into a frame from the front side, thereby easily achieving assembly of the hammers to the frame.

In order to accomplish the above object, a keyboard device according to a first aspect of the present invention comprises: a frame having a plurality of key support parts and a plurality of hammer support parts, the frame being formed of resin and being supported on an instrument main body; a plurality of keys supported at the key support parts such that the respective keys are pivoted by a key-pressing operation of a player in a vertical direction, the keys being arranged in parallel to each other along a width direction of the keyboard device; and a plurality of hammers arranged in parallel to each other along the width direction such that the hammers correspond to the respective keys, the hammers being supported at the respective hammer support parts such that the hammers are operatively connected to the corresponding keys below the corresponding keys to rotate about the respective hammer support parts, the hammers applying inertia to pivoting movements of the corresponding keys, wherein the frame has an opening portion open at a front area which faces the player, and located more frontward than the hammer support parts, and the frame is constructed such that the hammer support parts are located between an upper limit position and a lower limit position of the opening portion in the vertical direction, and the hammers can be inserted into the frame through the opening portion from the front area when the hammers are mounted to the respective hammer support parts.

Preferably according to a second aspect of the invention, a distance between the upper limit position and the lower limit position of the opening portion in the vertical direction is greater than a maximum vertical size of the hammers which is defined in the vertical direction in a state where a longitudinal direction of the hammers is parallel to a depth direction extending from front to rear of the keyboard.

Preferably according to a third aspect of the invention, a width of the opening portion in the width direction of the keyboard device is greater than a maximum width size of the hammers supported at the respective hammer support parts in the width direction of the keyboard device.

Preferably according to a fourth aspect of the invention, the opening portion is open continuously over each key zone covering a plurality of keys in the width direction of the keyboard device.

Preferably according to a fifth aspect of the invention, a frontmost position of the upper limit position of the opening portion is located more frontward than the hammer support parts, and an acute angle formed by a line segment interconnecting the frontmost position and the hammer support part and a line segment parallel to the depth direction through the hammer support part is 15 degrees or more when viewed from a side of the frame.

Preferably according to a six aspect of the invention, each of the hammers has an engagement part open rearward, the hammers are rotatably supported at the respective hammer support parts by engaging the engagement parts with the corresponding hammer support parts, and the hammers are moved rearward in parallel to each other when the hammers are mounted to the respective hammer support parts such that the engagement parts are engaged with the corresponding hammer support parts.

Preferably according to a seventh aspect of the invention, the upper limit position of the opening portion is located more frontward than the lower limit position and the hammer support parts, and the opening portion is open downward as well as rearward between the upper limit position and the lower limit position.

Preferably according to an eighth aspect of the invention, the frame has key guide parts provided for the respective keys to guide the pivoting movements of the respective keys, and the key guide parts are provided more frontward than the hammer support parts and more upward than the upper limit position of the opening portion.

Preferably according to a ninth aspect of the invention, each of the hammers is configured such that a rear part of each of the hammers is rotated upward during a going stroke of the corresponding key, a stopper part is provided at the upper limit position of the opening portion, and an initial position of each of the hammers is restricted by contact between a bottom of the stopper part and each of the hammers.

According to the first aspect of the present invention, it is possible to insert the hammers into the frame from the front side, thereby easily achieving the assembly of the hammers to the frame.

According to the second aspect of the present invention, it is possible to insert the hammers into the frame without changing the angle of the hammers in the rotation direction thereof during the assembly of the hammers to the frame, and it is possible to easily insert the hammers into the frame in a state where the longitudinal direction of the hammers is parallel to the depth direction of the keyboard device.

According to the third aspect the present invention, it is possible to insert the hammers into the frame without changing the angle of the hammers in the width direction of the keyboard device during the assembly of the hammers to the frame, and it is possible to easily insert the hammers into the frame in a state where the longitudinal direction of the hammers is parallel to the depth direction.

According to the fourth aspect of the present invention, it is possible to secure a sufficient area for the opening portion, thereby easily achieving assembly of the hammers to the frame, and, at the same time, to simultaneously insert the plurality of hammers into the frame.

According to the fifth aspect of the present invention, it is possible to easily achieve the insertion and assembly of the hammers to the frame.

According to the sixth aspect of the present invention, it is possible to easily assemble the hammers to the frame by moving the hammers almost in parallel without changing the physical position of the hammers very much.

According to the seventh aspect of the present invention, it is possible to more easily achieve the insertion and assembly of the hammers to the frame.

According to the eighth aspect of the present invention, the key guide parts are prevented from becoming obstacles during the assembly of the hammers to the frame, and therefore, it is possible to more easily achieve the insertion and assembly of the hammers to the frame.

According to the ninth aspect of the present invention, a major part of the opening portion is formed below the stopper part, and therefore, the initial stopper may not become an obstacle during the assembly of the hammers to the frame.

DETAILED DESCRIPTION OF THE INVENTION

Hereinafter, an embodiment of the present invention will be described in detail with reference to the accompanying drawings.

Figure 1:
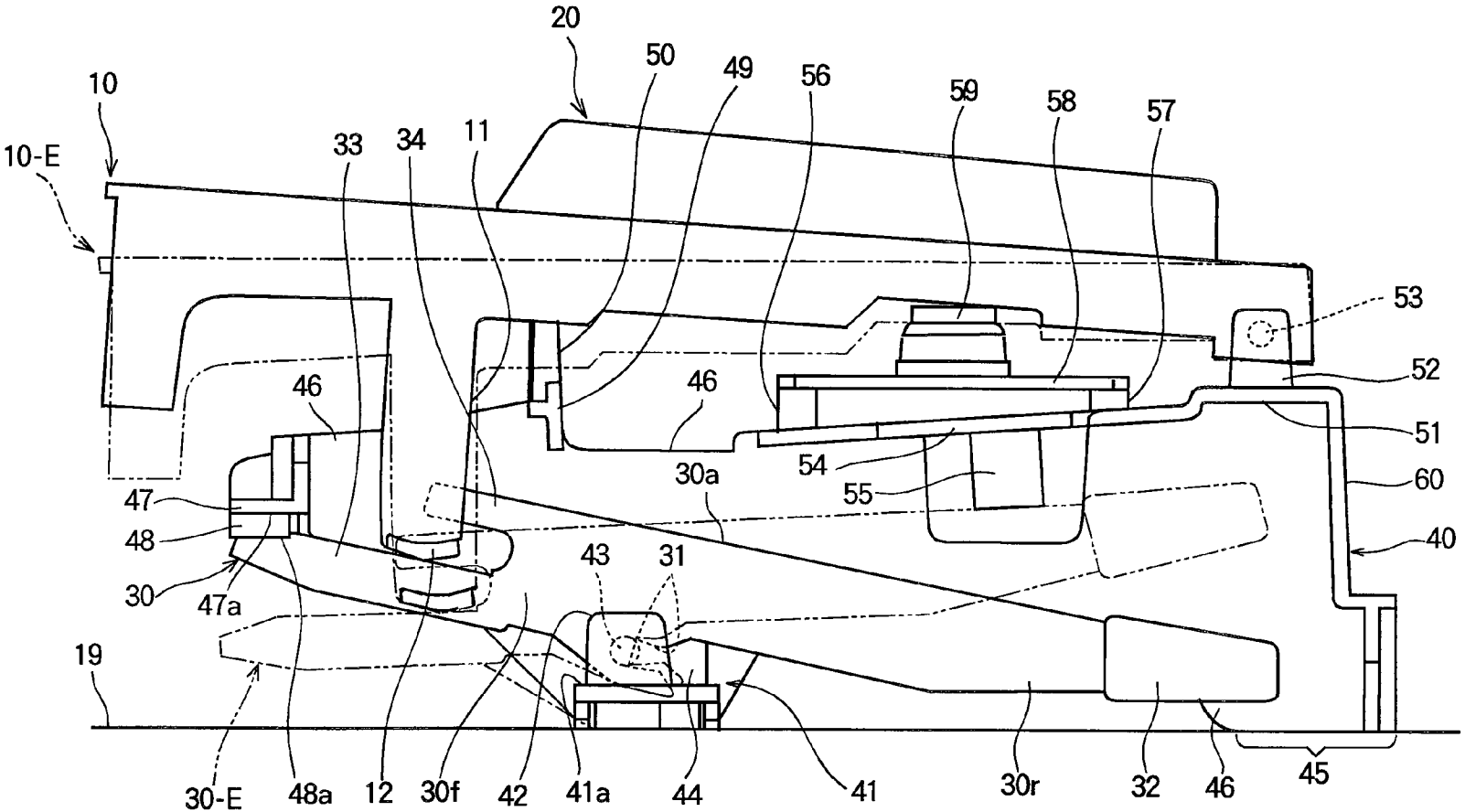
FIG. 1 is a side view illustrating the interior structure of a keyboard device according to an embodiment of the present invention.

FIG. 1 is a side view illustrating the interior structure of a keyboard device according to an embodiment of the present invention. The keyboard device is applicable to, for example, an electronic keyboard instrument. The keyboard device is constructed such that a plurality of white keys 10, a plurality of black keys 20, and a plurality of hammers 30 are arranged in a frame 40 formed of a resin in one united body. It is assumed that the side where a player is positioned with respect to the keyboard device is the front of the keyboard device. Therefore, the left and right of the drawing correspond to the front and rear of the keyboard devices, respectively. Also, it is assumed that the left-and-right direction is determined relative to the player.

The white keys 10 and the black keys 20 are arranged in parallel along the left-and-right direction (also referred to as the "side-by-side arrangement direction of keys"). The hammers 30 are arranged in parallel along the side-by-side arrangement direction of keys which is a width direction of the keyboard device. The hammers 30 are arranged such that the hammers 30 correspond to the respective keys. Specifically, the hammers 30 are arranged below the respective keys to apply inertia to pivoting movements of the respective keys.

Figure 2:
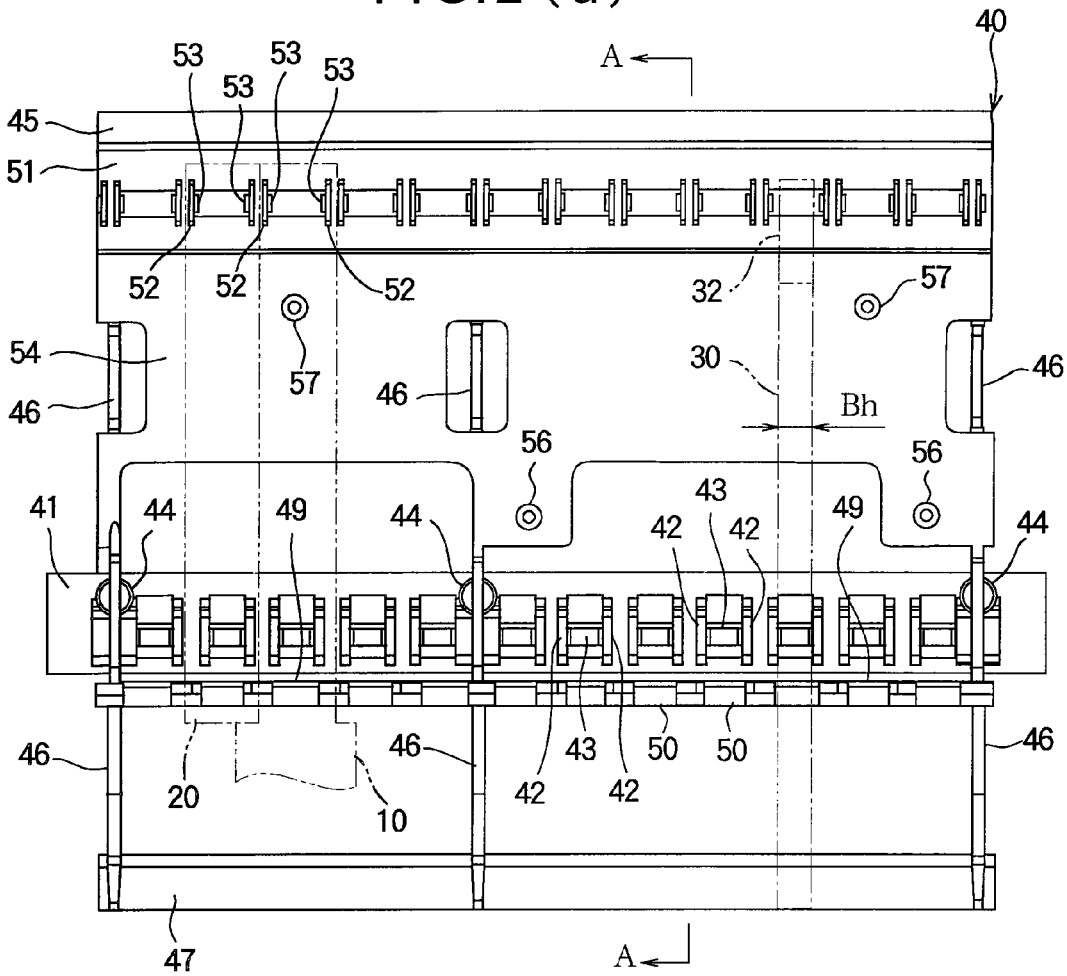
FIGS. 2(*a*) and 2(*b*) are a plan view and a front view illustrating a frame, respectively.
Figure 2:
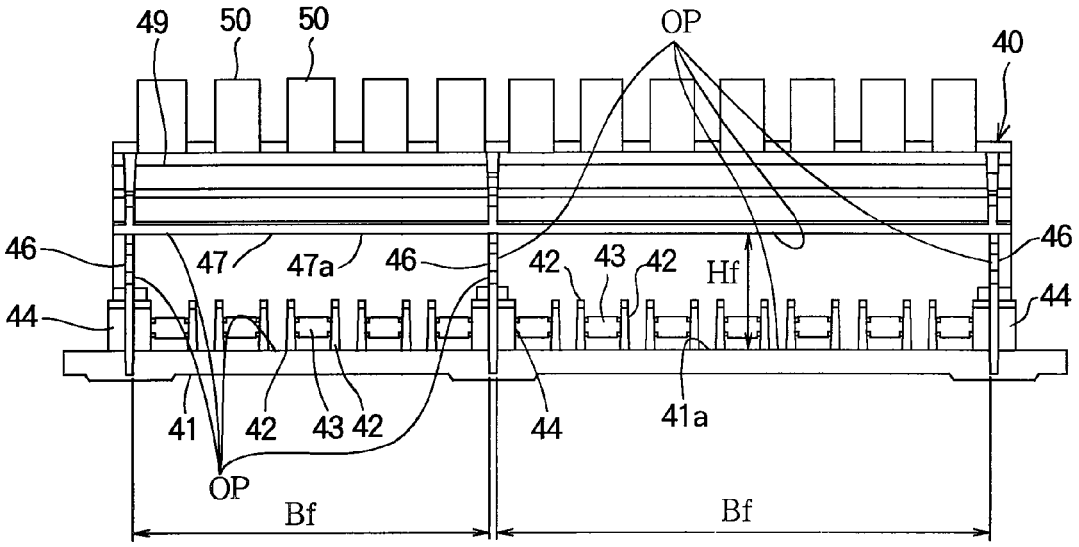
Figure 3:
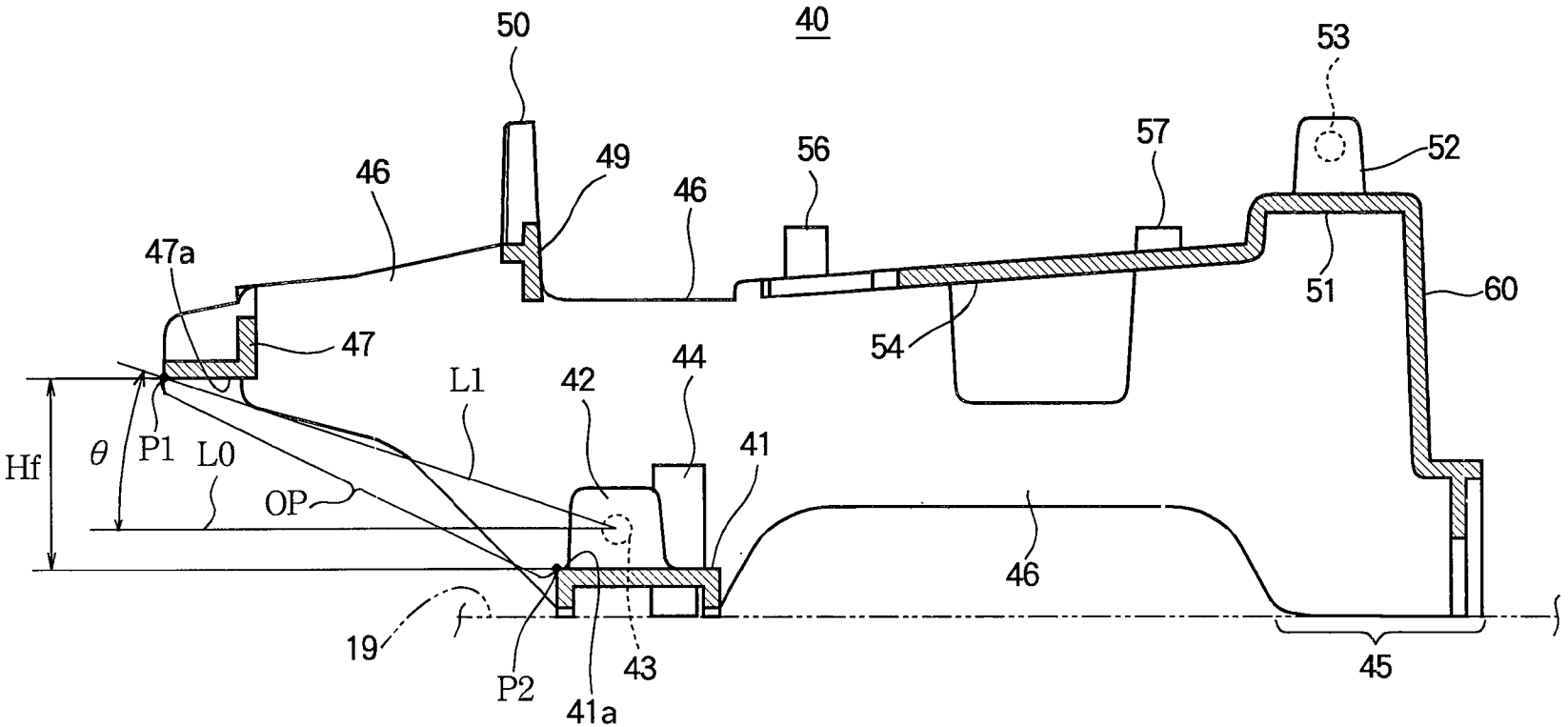
FIG. 3 is a sectional view taken along line A-A of FIG. 2(*a*).

FIGS. 2(*a*) and 2(*b*) are a plan view and a front view illustrating a frame. FIG. 3 is a sectional view taken along line A-A of FIG. 2(*a*). Although only one octave portion of the frame 40 is shown in FIGS. 2(*a*) and 2(*b*), the frame 40 may be shown to have a length corresponding to a key zone having a plurality of keys or the entirety of the keys.

The white keys 10 and the black keys 20 are supported at corresponding key support parts 53 of the frame 40 in such a manner that the front ends of the white keys 10 and the black keys 20 can vertically pivot about the key support parts 53. The key support parts 53 may support the keys 10 and 20 in a swinging manner. Alternatively, the key support parts 53 may be configured in a hinge type structure. That is, the structure of the key support parts 53 is not restricted. The hammers 30 are supported at corresponding hammer rotation shafts 43 of the frame 40 in such a manner that the hammers 30 can vertically rotate (the front ends and rear ends of the hammers 30 can vertically pivot) about the hammer rotation shafts 43. A lower perpendicular piece 11 is suspended downward from the front part of each of the white keys 10. The lower end of the lower perpendicular piece 11 constitutes a hammer drive part 12 including a shock-absorbing member. The same structure is applied to each of the black keys 20.

As shown in FIG. 1, each of the hammers 30 is constructed in a rod-shaped structure including an engagement depression 31 to engage with the corresponding hammer rotation shaft 43, a front extension part 30*f* located in front of the engagement depression 31, and a rear extension part 30*r* located in the rear of the engagement depression 31. The engagement depression 31 is open at the rear thereof. At the rear end of the rear extension part 30*r* is provided a mass part 32 which occupies a major portion of the entire mass of each of the hammers 30. At the front extension part 30*f* is formed a claw-shaped engagement part including a long lower engagement part 33 and a short upper engagement part 34. The lower engagement part 33 and the upper engagement part 34 are in continuous engagement with the hammer drive part 12 of the corresponding one of the white keys 10 and the black keys 20. Each of the hammers 30 is operatively connected to the corresponding one of the keys such that each of the hammers 30 can rotate in both the going direction and the returning direction.

In FIG. 1, the white keys 10, the black keys 20, and the hammers 30 are shown in an initial state where the white keys 10, the black keys 20, and the hammers 30 are not pressed. At the same time, the white keys 10 and the hammers 30 are shown as white keys 1-E and hammers 30-E in a key-pressing end state.

The frame 40 is manufactured in one united body by injection molding. The frame 40 is fixed to the top of a deck 19 (See FIGS. 1 and 3). The deck 19 may be part of the instrument main body, or may be a bottom plate of a lower case while the deck 19 is not particularly named. As will be described hereinafter in detail, the frame 40 is constructed in a structure in which portions of the frame 40 extending in one united body over the total length in the side-by-side arrangement direction of keys are connected to one another by a plurality of vertical ribs 46 spaced apart from one another in the side-by-side arrangement direction of keys.

First, as shown in FIG. 3, a stopper mount part 47 is provided at the frontmost part of the frame 40. At the rear of the stopper mount part 47 is provided a key guide connection part 49, which is located above the stopper mount part 47. At the rear of the key guide connection part 49 is provided a front side support part 41, which is located at the lowermost part of the frame 40. A rear side support part 45 is provided at the lowermost part of the rear of the frame 40. The lower ends of the front side support part 41 and the rear side support part 45 are in direct contact with the deck 19.

A rear side wall part 60 vertically rises upward from the rear side support part 45 such that the rear side wall part 60 forms a step toward the front side. A key support part connection part 51 extends frontward from the upper part of the rear side wall part 60 in one united body. A step is formed toward the lower side from the front part of the key support part connection part 51. A plate-shaped part 54 extends frontward while the plate-shaped part 54 is inclined gradually downward. The plate-shaped part 54 is approximately the middle of the frame 40 in the frontward-and-rearward direction which is a depth direction of the keyboard device. The plate-shaped part 54 extends more rearward than the front side support part 41.

In particular, the stopper mount part 47, the key guide connection part 49, the front side support part 41, the key support part connection part 51, and the plate-shaped part 54 are "portions of the frame 40 extending in one united body over the total length in the side-by-side arrangement direction of keys" (See FIGS. 2(*a*) and 2(*b*)). These portions, the rear side support part 45, and the rear side wall part 60 are connected to one another in one united body by the vertical ribs 46 (See FIG. 3). The vertical ribs 46 are provided such that one vertical rib 46 is allotted to several keys. For example, as shown in FIGS. 2(*a*) and 2(*b*), two or three vertical ribs 46 may be provided for each octave, although the number of the vertical ribs 46 is not particularly restricted.

As shown in FIG. 1, an initial stopper 48 is mounted to the bottom 47*a* of the stopper mount part 47 such that the initial stopper 48 contacts the lower engagement part 33 of the corresponding hammer 30 to restrict a rotation start position of the hammer 30 during the going stroke of the pressed key. In a state in which no key is pressed, the rear extension part 30*r* of the hammer 30 is lowered due to the weight of the mass part 32, with the result that the lower engagement part 33 is in constant contact with the bottom 48*a* of the initial stopper 48. On the other hand, the lower engagement part 33 and the hammer drive part 12 of the corresponding one of the white keys 10 and the black keys 20 are constantly engaged with each other. As a result, the rotation start position of the hammer 30 is restricted. Consequently, the position where no key is pressed, i.e., the initial position of each of the white keys 10 and the black keys 20, is also restricted, and therefore, the respective key face positions of the white keys 10 and the black keys 20 are uniformly aligned.

An end stopper 55 is mounted to the bottom of the plate-shaped part 54 such that the end stopper 55 contacts the mass part 32 of the rear extension part 30*r* of the corresponding hammer 30 to restrict a rotation end position of the hammer 30. When a key-pressing operation is performed, the hammer drive part 12 of each of the keys 10 and 20 drives the lower engagement part 33 of the hammer 30, with the result that the hammer 30 rotates in the counterclockwise direction of FIG. 1. When the rear extension part 30*r* comes into contact with the end stopper 55, the rotation end position of each of the keys 10 and 20 and the hammer 30 is restricted during the going stroke of the pressed key. When a key-releasing operation is performed in a key-pressing end state, the returning stroke of the pressed key is performed. As a result, the hammer 30 rotates in the clockwise direction due to the weight of the mass part 32 to return to its initial position.

Both the initial stopper 48 and the end stopper 55 are formed of material, such as felt, having a shock-absorbing function, and are provided in one united body over the total length in the side-by-side arrangement direction of keys. Alternatively, the initial stopper 48 and the end stopper 55 may be provided for each hammer 30. As another alternative, the initial stopper 48 and the end stopper 55 may be formed of a soft material such as elastomer, and may be formed at the frame 40 in one united body by one-piece molding through two-color molding. A plurality of board mount parts 56 and 57 are formed at the top of the plate-shaped part 54 in one united body (Also see FIGS. 2(*a*) and 2(*b*)). A board 58 is threadedly fixed to the board mount parts 56 and 57.

A key switch 59 corresponding to each of the keys is disposed on the board 58. When one of the keys 10 and 20 is pressed, the key switch 59 senses the key-pressing operation of the corresponding one of the keys 10 and 20. The instrument main body includes a musical sound generation device (not shown), which generates a musical sound based on the sensing result of the key switch 59.

As shown in FIGS. 1 to 3, a key guide part 50 protrudes upward from the key guide connection part 49 in one united body. The key guide part 50 is provided for each key to guide the pivoting movement of the corresponding key. The key guide part 50 may be formed separately from the frame 40 and then fixed to the frame 40. A pair of protruding pieces 42 protrude from the top 41*a* of the front side support part 41 such that the protruding pieces 42 correspond to each hammer 30. The hammer rotation shaft 43 is formed between a pair of protruding pieces 42.

A plurality of bosses 44 are also formed at the front side support part 41 in one united body. Furthermore, although not shown, a plurality of bosses are also formed at the rear side support part 45 in one united body. The frame 40 is fixed to the instrument main body by threadedly fixing the deck from below through threaded holes (not shown) provided in these bosses 44. Positions where the bosses 44 are formed in the side-by-side arrangement direction of keys correspond to the positions where the vertical ribs 46 are formed. Consequently, various kinds of force applied to the frame 40 are easily transmitted to the deck 19 in a direct manner through the vertical ribs 46 and the bosses 44.

A pair of protruding pieces 52 protrude from the top of the key support part connection part 51 in one united body such that the protruding pieces 52 correspond to each key. The above-described key support parts 53 are formed at the surface where a pair of protruding pieces 52 are opposite to each other.

The initial stopper 48, the key guide part 50, the hammer rotation shaft 43, the key support part 53, the key switch 59, and the end stopper 55 engage, in contact, with the components of the keyboard device excluding the frame 40 during the use of the keyboard device. The initial stopper 48, the key guide part 50, the hammer rotation shaft 43, the key support part 53, the key switch 59, and the end stopper 55 are components causing the frame 40 to function as a key frame and a hammer frame to appropriately support the keys 10 and 20 and the hammers 30. These components are referred to as "frame function parts." The front side support part 41 and the rear side support part 45 have a function to make them to be fixed to the deck 19 in a direct contact manner. Consequently, the front side support part 41 and the rear side support part 45 are also the "frame function parts."

On the other hand, the key guide connection part 49, the front side support part 41, the key support part connection part 51, and the plate-shaped part 54 function to interconnect a plurality of identical components (key guide part 50, hammer rotation shaft 43, key support part 53, key switch 59) in the side-by-side arrangement direction of keys. The stopper mount part 47 is the portion where the initial stopper 48 is mounted. Also, the stopper mount part 47 is the portion extending continuously in one united body in the side-by-side arrangement direction of keys. The plate-shaped part 54 is the portion where the end stopper 55 is mounted, and, at the same time, the board 58 is mounted via the board mount parts 56 and 57. Also, the plate-shaped part 54 is the portion extending continuously in one united body in the side-by-side arrangement direction of keys. The front side support part 41 and the rear side support part 45 are in contact with the deck 19. The front side support part 41 and the rear side support part 45 are the portions receiving reaction force from the deck 19 when each of the keys is pressed. Also, the front side support part 41 and the rear side support part 45 are the portions extending continuously in one united body in the side-by-side arrangement direction of keys. The key guide connection part 49, the front side support part 41, the key support part connection part 51, and the plate-shaped part 54, the stopper mount part 47, and the rear side support part 45 are referred to as "integrated continuous parts."

The "integrated continuous parts" are defined as "portions formed at the frame 40 in one united body, extending continuously in one united body over a key zone having a plurality of keys in the side-by-side arrangement direction of keys, receiving external force directly or via the frame function parts, and/or where components constructed separately from the frame 40 are mounted."

As shown in FIGS. 2(*b*) and 3, opening portions OP to open the interior of the frame 40 frontward without obstacles are formed in the frame 40. That is, the bottom 47*a* of the stopper mount part 47 and the top 41*a* of the front side support part 41 are level surfaces, and the opening portions OP are formed in these surfaces and the neighboring vertical ribs 46 (See FIG. 2(*b*)). As shown in FIG. 3, the bottom 47*a* of the stopper mount part 47 and the top 41*a* of the front side support part 41 are the upper limit position and the lower limit position of the opening portions OP, respectively. In the upward-and-downward direction which is a vertical direction of the keyboard, the hammer rotation shafts 43 are located between the upper limit position and the lower limit position. The distance between the upper limit position and the lower limit position in the upward-and-downward direction is defined as "a vertical distance Hf of opening portions."

In the frontward-and-rearward direction, the bottom 47*a* of the stopper mount part 47 is located more frontward than the top 41*a* of the front side support part 41. Therefore, the opening portions OP are also referred to as openings open downward in addition to the openings open frontward.

When viewing the front of the frame 40, the hammer rotation shafts 43 can be visually recognized through the opening portions OP (See FIG. 2(*b*)). The upward limit angle at which the hammer rotation shafts 43 can be visually recognized is decided by a positional relationship between the hammer rotation shafts 43 and the frontmost position P1 (See FIG. 3) of the bottom 47*a*. As shown in FIG. 3, an angle θ, which is an acute angle, formed at the front area by a line segment L1 interconnecting the frontmost position P1 and each of the hammer rotation shafts 43 and a line segment L0 parallel in the frontward-and-rearward direction through each of the hammer rotation shafts 43 is 20 degrees when viewed from the widthwise side of the frame 40. From a point of view to easily achieve the insertion and assembly of the hammers 30 to the frame 40, it is preferable for the angle θ to be 15 degrees or more.

Figure 4A:
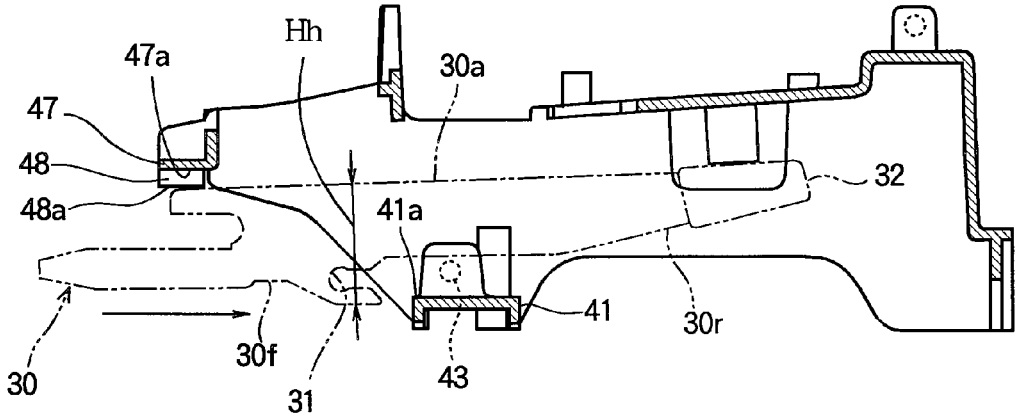
FIGS. 4(*a*) to 4(*c*) are side views of the frame illustrating a process for rotatably arranging a hammer at the frame.
Figure 4B:
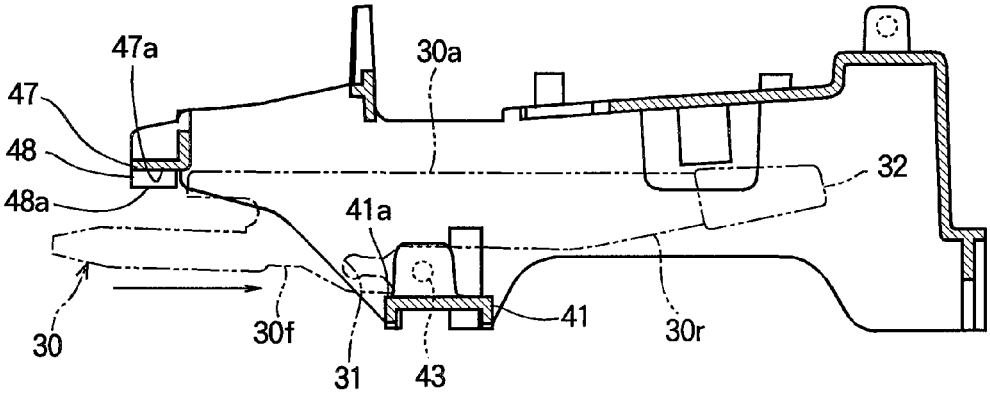
Figure 4C:
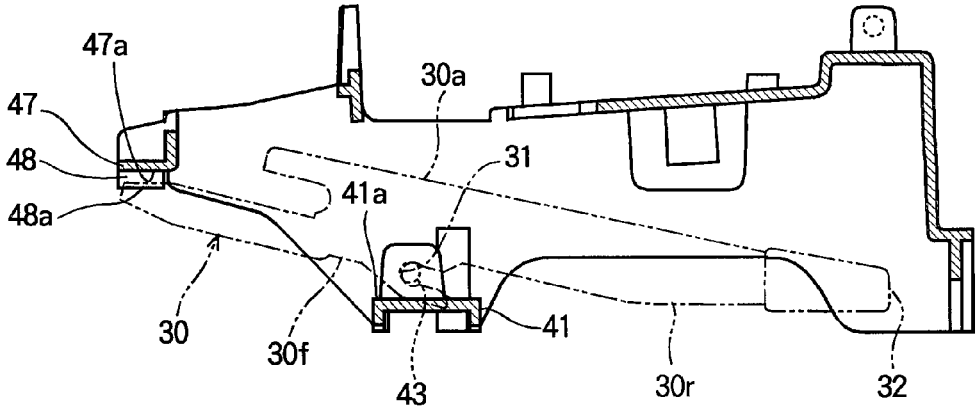

FIGS. 4(*a*) to 4(*c*) are side views of the frame 40 illustrating a process for rotatably arranging each of the hammers 30 at the frame 40. In the assembly process, each of the hammers 30 is inserted into the frame 40 through the corresponding opening portion OP from the front side.

The maximum vertical size of each hammer 30 in the vertical direction is denoted by Hh (See FIG. 4(*a*)). The vertical distance Hf of opening portions is greater than the maximum vertical size Hh. Here, a major portion of the top 30*a* of the hammer 30 is uniform and parallel in the longitudinal direction of the hammer 30 from the front extension part 30*f* to the rear extension part 30*r*. Therefore, the maximum vertical size Hh is defined as the maximum vertical size in the vertical direction in a state where the hammer 30 is rotatably support at the corresponding hammer rotation shaft 43 of the frame 40 and the longitudinal direction of the hammer 30 is parallel in the depth direction. Specifically, the maximum vertical size is the size of a region including the engagement depression 31 in the vertical direction. Strictly speaking, however, when the mass part 32 protrudes more upward than the top 30*a* or when a protrusion part is provided with respect to the top 30*a*, it is preferable to regard the top of the mass part 32 or the protrusion part as the upper limit position of the maximum vertical size Hh.

As shown in FIG. 2(*b*), both the two opening portions OP are open continuously over each key zone having a plurality of keys in the side-by-side arrangement direction of keys (the opening portions are formed over a plurality of divided regions of the hammers 30). Consequently, it is natural that the crosswise width Bf of each of the opening portions OP in the side-by-side arrangement direction of keys is sufficiently large as compared with the maximum width size Bh (see FIG. 2(*a*)) of each of the hammers 30 in the side-by-side arrangement direction of keys.

In the above-described structure, when the hammer 30 is assembled to the frame 40, the hammer 30 is inserted through the corresponding opening portion OP from the front side in a state where the longitudinal direction of the hammer 30 is almost parallel to the frontward-and-rearward direction (See FIGS. 4(*a*) and 4(*b*)). Here, the initial stopper 48 is already mounted to the stopper mount part 47, but a major portion of the opening portion OP is formed below the start stopper 48, with the result that the initial stopper 48 may not become an obstacle during the assembly of the hammer 30 to the frame 40.

However, when the vertical distance Hf of opening portions has no sufficient tolerance as compared with the maximum vertical size Hh of the hammer 30, the initial stopper 48 may be mounted after the assembly of the hammer 30 to the frame 40. Alternatively, the distance between the bottom 48*a* of the initial stopper 48 and the top 41*a* of the front side support part 41 in the upward-and-downward direction may be set to be greater than the maximum vertical size Hh of the hammer 30. In this case, it is possible to assembly the hammer 30 by moving the hammer 30 rearward while the hammer 30 is parallel in the frontward-and-rearward direction even in a state where the stopper mount part 47 is pivotably mounted.

The engagement depression 31 of the hammer 30 is open at the rear thereof. Consequently, when the hammer 30 is moved rearward in parallel, the engagement depression 31 naturally engages with the corresponding hammer rotation shaft 43 (See FIG. 4(*c*)). Until the engagement depression 31 is engaged with the corresponding hammer rotation shaft 43 after the insertion of the hammer 30 into the frame 40 is initiated, it is not necessary to change the angle of the hammer 30 in the upward-and-downward direction (the clockwise direction of FIGS. 4(*a*) to 4(*c*)), and therefore, it is possible to easily assemble the hammer 30 to the frame 40 by moving the hammer 30 almost in parallel to the depth direction without changing the physical position or attitude of the hammer 30 very much.

When viewing the opening portion OP in the frontward-and-rearward direction, as shown in FIG. 3, the position of the key guide part 50 is located more upward than the bottom 47*a* of the stopper mount part 47, which is the upper limit position of the opening portion OP. Consequently, the key guide part 50 is prevented from becoming an obstacle when assembling the hammer 30 to the frame 40, and therefore, it is possible to easily achieve the insertion and assembly of the hammer 30 to the frame 40.

According to this embodiment, it is possible to insert the hammer 30 into the frame 40 through the corresponding opening portion OP from the front side when assembling the hammer 30 to the frame 40. Consequently, it is possible to easily achieve the assembly of the hammer 30 to the frame 40. In particular, the vertical distance Hf of the opening portion OP is greater than the maximum vertical size Hh of the hammer 30 (See FIGS. 3 and 4(*a*)). Consequently, it is possible to insert the hammer 30 into the frame 40 without changing the angle of the hammer 30 in the rotation direction.

Furthermore, the crosswise width Bf of the opening portion OP is sufficiently large as compared with the maximum width size Bh of the hammer 30 (see FIG. 2(*a*)), and therefore, it is possible to insert the hammer 30 without changing the angle of the hammer 30 in the side-by-side arrangement direction of keys. Consequently, it is possible to easily and simply insert the hammer 30 into the frame 40 in a state where the longitudinal direction of the hammer 30 is parallel in the frontward-and-rearward direction. In addition, the opening portion OP is open continuously over each key zone having a plurality of keys. Consequently, it is possible to secure a sufficient area for the opening portion and, at the same time, to simultaneously insert a plurality of hammers 30 into the frame 40.

Furthermore, the acute angle (angle θ) formed at the front side by the line segment L1 and the line segment L0 of the opening portion OP is 20 degrees (See FIG. 3). Consequently, it is possible for a worker to easily visually recognize the hammer rotation shaft 43 from the front side of the frame 40 and to easily take aim when engaging the hammer 30 with the corresponding engagement depression 31. Also, since the angle θ is large, and the opening portion OP is also open downward, it is possible to increase a degree of freedom of the angle in the upward-and-downward direction at the time of inserting the hammer 30 and thus to easily achieve the insertion and assembly of the hammer 30 to the frame 40.

Meanwhile, the male and female relationship between the engagement depression 31 of the hammer 30 and the hammer rotation shaft 43 of the frame 40 may be reversed.

Meanwhile, it is not entirely necessary to form the entirety of the frame 40 of resin in one united body. The fundamental portions, such as the integrated continuous parts and the vertical ribs 46, of the frame 40 may be formed of resin in one united body. Consequently, the frame 40 may include a separate body, or part of the frame 40 may be formed of another material.

As described above, according to the major aspect of the invention, the keyboard device comprises a frame (40) having a plurality of key support parts (53) and a plurality of hammer support parts (43), the frame being formed of resin in one united body and being supported on an instrument main body (19), a plurality of keys (10, 20) supported at the key support parts such that the respective keys are pivoted by a key-pressing operation, the keys being arranged in parallel, and a plurality of hammers (30) arranged in parallel such that the hammers correspond to the respective keys, the hammers being supported at the respective hammer support parts such that the hammers are operatively connected to the corresponding keys below the corresponding keys to rotate about the respective hammer support parts, the hammers applying inertia to pivoting movements of the corresponding keys, the frame having an opening portion (OP) open at least at a front area, which is a player side, located more frontward than the hammer support parts, the frame being constructed such that the hammer support parts are located between an upper limit position (47*a*) and a lower limit position (41*a*) of the opening portion in an upward-and-downward direction, and the hammers can be inserted into the frame through the opening portion from the front side when the hammers are mounted to the respective hammer support parts.

Preferably, the hammers are supported at the respective hammer support parts, a distance (Hf) between the upper limit position and the lower limit position of the opening portion in the upward-and-downward direction is greater than a maximum vertical size (Hh) of the hammers in the upward-and-downward direction in a state where a longitudinal direction of the hammers is parallel to a frontward-and-rearward direction Preferably, a width (Bf) of the opening portion in a side-by-side arrangement direction of keys is greater than a maximum width size (Bh) of the hammers supported at the respective hammer support parts in the side-by-side arrangement direction of keys.

Preferably, the opening portion is open continuously over each key zone having a plurality of keys in the side-by-side arrangement direction of keys.

Preferably, a frontmost position (P1) of the upper limit position of the opening portion is located more frontward than the hammer support parts, and an acute angle formed by a line segment (L1) interconnecting the frontmost position and each of the hammer support parts and a line segment (L0) parallel in the frontward-and-rearward direction through each of the hammer support parts is 15 degrees or more when viewed from a widthwise side of the frame.

Preferably, each of the hammers has an engagement part (31) open rearward, the hammers are rotatably supported at the respective hammer support parts by engaging the engagement parts with the corresponding hammer support parts, and the hammers are moved rearward in parallel, when the hammers are mounted to the respective hammer support parts, such that the engagement parts can be engaged with the corresponding hammer support parts.

Preferably, the upper limit position of the opening portion is located more frontward than the lower limit position and the hammer support parts, and the opening portion is open downward as well as rearward between the upper limit position and the lower limit position.

Preferably, the frame has key guide parts (50) provided for the respective keys to guide pivoting movements of the respective keys, and the key guide parts are provided more frontward than the hammer support parts and more upward than the upper limit position of the opening portion.

Preferably, each of the hammers is configured such that a rear part (30*r*) of each of the hammers is rotated upward during a going stroke of the corresponding pressed key, a stopper part (48) is provided at the upper limit position of the opening portion, and an initial position of each of the hammers is restricted by contact between a bottom (48*a*) of the stopper part and each of the hammers during the going stroke of the pressed key.

The invention claimed is:

1. A keyboard device comprising:

a frame having a plurality of key support parts and a plurality of hammer support parts, the frame being formed of resin and key supported on an instrument main body;

a plurality of keys supported at the key support parts such that the respective keys are pivoted by a key-pressing operation of a player in a vertical direction, the keys being arranged in parallel to each other along a width direction of the keyboard device; and a plurality of hammers arranged in parallel to each other along the width direction such that the hammers correspond to the respective keys, the hammers being supported at the respective hammer support parts such that the hammers are operatively connected to the corresponding keys below the corresponding keys to rotate about the respective hammer support parts, the hammers applying inertia to pivoting movements of the corresponding keys, wherein the frame has an opening portion open at a front area which faces the player, and located more frontward than the hammer support parts, and the frame is constructed such that the hammer support parts are located between an upper limit position and a lower limit position of the opening portion in the vertical direction, and the hammers can be inserted into the frame through the opening portion from the front area when the hammers are mounted to the respective hammer support parts.

2. The keyboard device according to claim 1, wherein a distance between the upper limit position and the lower limit position of the opening portion in the vertical direction is greater than a maximum vertical size of the hammers which is defined in the vertical direction in a state where a longitudinal direction of the hammers is parallel to a depth direction extending from front to rear of the keyboard.

3. The keyboard device according to claim 1, wherein a width of the opening portion in the width direction of the keyboard device is greater than a maximum width size of the hammers supported at the respective hammer support parts in the width direction of the keyboard device.

4. The keyboard device according to claim 1, wherein the opening portion is open continuously over each key zone covering a plurality of keys in the width direction of the keyboard device.

5. The keyboard device according to claim 1, wherein a frontmost position of the upper limit position of the opening portion is located more frontward than the hammer support parts, and an acute angle formed by a line segment interconnecting the frontmost position and the hammer support part and a line segment parallel to the depth direction through the hammer support part is 15 degrees or more when viewed from a side of the frame.

6. The keyboard device according to claim 1, wherein each of the hammers has an engagement part open rearward, the hammers are rotatably supported at the respective hammer support parts by engaging the engagement parts with the corresponding hammer support parts, and the hammers are moved rearward in parallel to each other when the hammers are mounted to the respective hammer support parts such that the engagement parts are engaged with the corresponding hammer support parts.

7. The keyboard device according to claim 1, wherein the upper limit position of the opening portion is located more frontward than the lower limit position and the hammer support parts, and the opening portion is open downward as well as rearward between the upper limit position and the lower limit position.

8. The keyboard device according to claim 1, wherein the frame has key guide parts provided for the respective keys to guide the pivoting movements of the respective keys, and the key guide parts are provided more frontward than the hammer support parts and more upward than the upper limit position of the opening portion.

9. The keyboard device according to claim 1, wherein each of the hammers is configured such that a rear part of each of the hammers is rotated upward during a going stroke of the corresponding key, a stopper part is provided at the upper limit position of the opening portion, and an initial position of each of the hammers is restricted by contact between a bottom of the stopper part and each of the hammers.

* * * * *